US009638384B2

(12) United States Patent
Japs et al.

(10) Patent No.: US 9,638,384 B2
(45) **Date of Patent: *May 2, 2017**

(54) PLASTIC COVER LENS OF A HEADLAMP WITH DECORATIVE TRIM DISPOSED ON THE EXTERIOR SURFACE

(71) Applicant: Hella KGaA Hueck & Co., Lippstadt (DE)

(72) Inventors: Eudard Japs, Herford (DE); Lars Tillmann, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 60 days.

This patent is subject to a terminal disclaimer.

(21) Appl. No.: 14/599,032

(22) Filed: Jan. 16, 2015

(65) Prior Publication Data

US 2015/0204501 A1 Jul. 23, 2015

(30) Foreign Application Priority Data

Jan. 21, 2014 (DE) ..... 10 2014 100 606

(51) Int. Cl.
*F21S 8/10* (2006.01)

(52) U.S. Cl.
CPC ..... *F21S 48/155* (2013.01); *F21S 48/1208* (2013.01)

(58) Field of Classification Search
CPC ..... F21V 17/16; F21S 48/155; F21S 48/1208; F21S 8/1283; B60Q 1/18
See application file for complete search history.

(56) References Cited

U.S. PATENT DOCUMENTS

| | | | | | |
|---|---|---|---|---|---|
| 2,734,129 | A * | 2/1956 | Kahla | B60Q 1/18 | 359/892 |
| 4,237,523 | A * | 12/1980 | Moote | F21S 48/1131 | 362/2 |
| 5,180,219 | A * | 1/1993 | Geddie | F21S 48/1233 | 362/267 |
| 2015/0062952 | A1* | 3/2015 | Lessard | F21S 48/1208 | 362/549 |

FOREIGN PATENT DOCUMENTS

| | | | |
|---|---|---|---|
| DE | 1019622 | B | 11/1957 |
| DE | 102004026467 | A1 | 12/2005 |
| DE | 102004025232 | A1 | 1/2006 |
| DE | 102010056412 | A1 | 6/2012 |
| DE | 102011050163 | A1 | 11/2012 |
| DE | 10 2012 102 922 | | 10/2013 |
| DE | 102012102922 | A1 | 10/2013 |

* cited by examiner

*Primary Examiner* — Robert May
(74) *Attorney, Agent, or Firm* — Husch Blackwell LLP

(57) ABSTRACT

An assembly of a decorative trim on the exterior surface of a plastic cover lens of a headlamp. Locking means are molded on the outer side of the plastic cover lens, which extend out in a transverse direction (Y) pointing at an angle from the surface of the plastic cover lens. The decorative trim comprises locking means receivers into which the locking means engage, and at least one snapping means on the decorative trim and one complementary snapping means are provided on the plastic cover lens for securing the decorative trim against the transverse direction (Y).

8 Claims, 2 Drawing Sheets

PLASTIC COVER LENS OF A HEADLAMP WITH DECORATIVE TRIM DISPOSED ON THE EXTERIOR SURFACE

CROSS REFERENCE

This application claims priority to German Application No. 10 2014 100606.2, filed Jan. 21, 2014, which is hereby incorporated by reference.

FIELD OF TECHNOLOGY

The present invention relates to an assembly of a decorative trim on the exterior surface of a plastic cover lens of a headlamp.

BACKGROUND

DE 10 2004 025 232 A1 shows the assembly of a decorative trim on the exterior surface of a plastic cover lens of a headlamp, and decorative trim is secured with a seal-ing composition on the exterior surface of the plastic cover lens. For this purpose, the plastic cover lens comprises a fastening section having a fastening projection, and the terminal edge of the fastening extension forms a kind of comb with bumps and by means of the bumps, which are poured into the sealing composition, a durable, posi-tionally accurate assembly of the decorative trim on the exterior surface of the plastic cover lens is produced, when the sealing composition is cured. The disadvantage is that the decorative trim cannot be replaced readily, for instance, when it is damaged. Furthermore, the disadvantage arises, that upon installation of the decorative trim on the exterior surface of the plastic cover lens, curing time of the casting composition must be taken into account and the decorative trim must be secured according to the duration of the curing of the sealing composition.

Alternative assemblies of the decorative trim on the Exterior surface of the plastic cover lens are made possible by screw domes being constructed on the Exterior surface of the plastic cover lens, into which screws may be screwed in, and the decorative trim can be attached onto the exterior surface of the plastic cover lens with the screws. The screw domes can thereby eventually be covered by the decorative trim. The disadvantage is the screw domes are placed under mechanical tension by the screw connection of the decorative trim, especially when self-tapping screws are used, which are screwed into the screw domes. Through the application of lid cleaning agents, which are also used for the cleaning of plastic cover lens of headlamps for vehicles, the screw domes at an early stage may show signs of aging, which is to be avoided.

The decorative trim that should be attached to the exterior surface of headlamps may, depending on the design concept of a vehicle and, by way of example, also run along the exterior surface of the plastic cover lens for the subdivision of light functions of the headlamp, and the objective is thereby a permanent, positionally accurate and easily interchangeable assembly of a decorative trim on the of the plastic cover lens.

In case of damage to the decorative trim these can be easily released from the plastic cover lens, to further achieve that the holding geometries on the exterior surface of the plastic cover lens, particularly as an alternative to a screw dome, do not undergo excessive mechanical stresses, in order to ensure a durable stability of the decorative trim on the plastic cover lens.

SUMMARY OF THE INVENTION

The object of the invention is therefore to further develop an assembly of a decorative trim on the exterior surface of a plastic cover lens of a headlamp, which is simple in construction and with which the decorative trim can be easily replaced. In particular is it the object to further develop the assembly of the decorative trim in such a way that fasteners on the plastic cover lens are not subject to any excessive mechanical stresses The invention includes the technical character that locking means are constructed on the exterior surface of the plastic cover lens, which is pointing in a transverse direction, which extend outward in a transverse direction pointing at an angle from the surface of the plastic cover lens and so designed, that the decorative trim comprises receiver for the locking means, in which the locking means engages, and in that furthermore at least one snapping means on the decorative trim and a complementary snapping means on the plastic cover lens for securing of the decorative trim towards the transverse direction are designed.

With the inventive assembly of the decorative trim which may comprise, for example, an electroplated chrome front side on the outer side of the plastic cover lens, the essential advantage is achieved, that no sealing composition is required, in order to manufacture a connection from the decorative trim with the plastic cover lens. Furthermore the advantage is achieved in that no particularly high mechanical stresses are generated in the locking means for the assembly of the decorative trim such as occur, for example, in a screwing a screw into a screw dome. The locking means can be carried out advantageously so that the decorative trim engages in a form-fitting manner with the receiver of the locking means, without locally high mechanical stresses in the locking means nor in the locking means's receiver being generated. For this purpose the locking mechanism according to the invention is formed with a direction of extension, extending in a transverse direction, and the locking means extends out at an angle from the surface of the plastic cover lens. The locking mechanism can thereby be defined with a main direction of extension, which extends in the transverse direction of the headlamp, that is greater than 0° and less than 90° from the surface of the plastic cover lens out at an angle, whereby the slant may have a component in the transverse direction and another component in the normal direction to the plastic cover lens.

Should the decorative trim with the locking means receiver latch onto the locking means, so too according to the invention, a snapping means in a complementary snapping means will be latched, whereby the decorative trim is braced against the transverse direction to the locking means. The snapping means and the complementary snapping means can be designed as a simple latching or clip connection.

Should the snapping means from the complementary snapping means be released, so too can the decorative trim be removed from the plastic cover lens without much effort in order to, for example, replace a damaged decorative trim with a new decorative trim.

The locking means may comprise an extension designed in a cross-sectional geometric shape in the manner of a keyhole. This cross-sectional geometric shape in the manner of the keyhole in particular has a head section and a neck section. This offers the possibility of taking advantage of the form fit between the locking means and the locking means receiver by the wider development of the head section relative to the neck section, so that the locking means receiver engages the head section in the direction of the neck section. The form fit thus constructed is finally secured by the latching of the snapping means's complementary snapping means.

The head section may extend at an angle from the surface of the plastic cover lens, whereby the neck section extends like ribs between the head section and the surface of the plastic cover lens. Locking means emerge by means of the design of the geometric shape resembling a keyhole which are mechanically stable and even high mechanical stresses occurring in the locking means can be avoided, when pressure, for example, is applied by a foreign body on the decorative trim or, for example, in foreign object damage of the vehicle.

Through the construction of the neck section the advantage is also provided that in addition to securing the decorative trim in a transverse direction, this is secured in a vertical direction, since contact areas of the locking means receiver may lie in the decorative trim on the neck section, by which a securing of the decorative trim in the normal direction to the plastic cover lens is produced, which may for example corre-spond to the longitudinal direction of a vehicle, by the form fit of the locking means receiver in the head section.

Advantageously, the locking means receiver is formed as a substantially U-shaped recess on the mounting side of the decorative trim, wherein the U-shaped recess is formed corresponding to the angled extension of the locking means. The locking means receiver may be designed in one part with the body of the decorative trim, and the decorative trim in particular can be constructed by an electroplated chrome plastic body. The locking means receiver is thus manufactured with the body of the decora-tive trim in an injection molding process in one piece.

The U-shaped recess may encompass the locking means in the transitional region between the head section and the neck section in a limb-like manner, and the U-shaped recess is pushed through the open side of the U-shape of the geometric shape resembling a keyhole. If the edge of the decorative trim lies upon the surface of the plastic cover lens, the snapping means ultimately latches in the counter-locking means, which finally results in a fixed assembly of the decorative trim on the plastic cover lens.

The locking means present on the plastic cover lens and/or at least partially the surrounding field of instrumentation on the surface of the plastic cover lens may comprise a protective coating, and by avoiding stress peaks by securing the decorative trim with the locking means designed according to the invention, the resulting advantage is that such a protective coating is not damaged.

In the transition between the surface of the plastic cover lens and the molded locking means and/or the transition between the head section and the neck section, radii can respectively be formed. Not only is the locking means on the exterior surface of the plastic cover lens thereby designed suitable for injection molding, rather advantages result in the formation of mechanical stresses, since mechanical stress peaks are minimized by the radii. In particular, in the groove between the neck section and the head section, a radius can be provided corresponding to a radius of the limb-like U-shaped recess of the locking means receiver on the decorative trim. This results in a surface contact between the locking means receiver and the locking means, which is more highly resistant than, for example, a line contact.

The invention further relates to a headlamp for a vehicle with a plastic cover lens, on the exterior surface of which a decorative trim is arranged, wherein on the exterior surface of the plastic cover lens locking means are molded, which point in a transverse direction, extending out at an angle from the surface of the plastic cover lens, wherein the decorative trim comprises a locking means receiver, into which the locking means engage, and furthermore wherein at least one snapping means on the decorative trim and a complementary snapping means are provided on the plastic cover lens, which serve to secure the decorative trim against the transverse direction. The other features and attendant advantages which are previously described in connection with the assembly of the decorative trim on the plastic cover lens, are taken into account in the same manner for the headlamp according to the invention.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
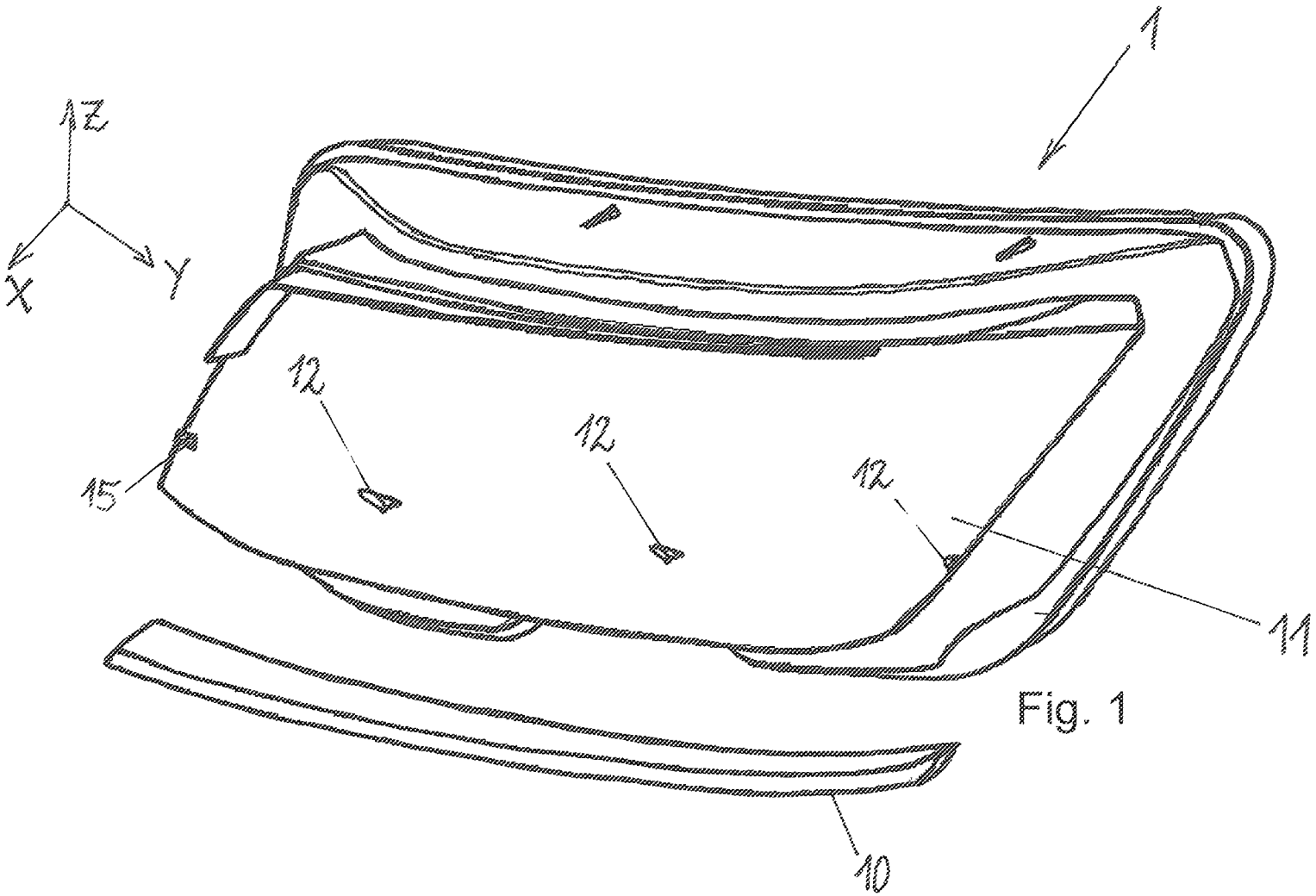
FIG. 1 is a perspective view of a plastic cover lens and a decorative trim in an unassembled assembly.

FIG. 1 shows an embodiment for forming an assembly 1 of a decorative trim 10 on the exterior surface of a plastic cover lens 11 of a headlamp, which may be built into a vehicle, for example. The plastic cover lens 11 comprises a peripheral region, which is used for connection with the housing of the headlamp, and an inner one, likewise of an area designed somewhat frame-shaped serves to create a light passage area. A system of coordinates shows the longitudinal direction X, which the light propagation direction of the light corresponds to, that can be provided with the headlamp and the longitudinal direction X in particular forms a vehicle longitudinal direction. The trans-verse direction Y forms a direction transverse to the longitudinal direction X in front of the headlamp, and Z refers to the vertical direction of the headlamp.

The decorative trim 10 is shown in a flying assembly in front of the plastic cover lens 11, which will be arranged on the light passage area on the front side of the plastic cover lens 11. The decorative trim 10 serves as a design element, but this can also fulfill technical tasks, for example, for the separation of individual light features of a headlamp.

In order to arrange the decorative trim 10 on the exterior surface of the plastic cover lens 11 locking means 12 are used, which are molded on the exterior surface of the plastic cover lens 11 in one piece. The locking means 12 extend approximately in the transverse direction Y, thereby placing them protruding at an angle from the surface of the plastic cover lens 11. The angled direction of extension of the locking means 12 in the transverse direction Y results from the tapered installation situation of the plastic cover lens 11 transversely to the longitudinal direction X of the vehicle.

By way of example, three locking means 12 are shown arranged on a common horizontal, wherein a counter-catch means 15 is provided on the outer side of the plastic cover lens 11, arranged approximately at the same height as the locking means 12, with which the decorative trim 10 can be secured in a latched assembly on the locking means 12 against the transverse direction Y, as further described in connection with the following figures.

The decorative trim 10 forms a galvanized chrome surface and is constructed in one piece. This can be removably attached on the plastic cover lens by assembly 1 ac-cording to the invention, wherein in particular the use of a casting material should be avoided.

Figure 2:
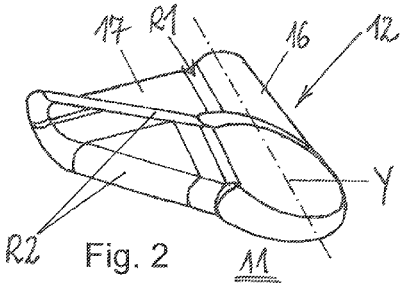
FIG. 2 is a detailed view of the locking means.

FIG. 2 shows a detailed view of a locking means 12 from an angled direction of view of the inside of the plastic cover lens 11 not shown, so that the locking means 12 extends out of the plastic cover lens 11 in the manner shown. The locking means 12 extends with a main section in a transverse direction Y, and in the main direction of extension formed thereby, the locking means 12 is a cross-sectional geometric shape in the manner of a keyhole. The geometric shape resembling a keyhole can be divided into a head section 16 and a neck section 17, wherein the head section 16 is approximately cylindrical shape extending in the transverse direction Y, and the neck section 17 forms a rib-like con-necting region between the surfaces of the fixture cross-section on the exterior surface of the plastic cover lens 11 and the head section 16. In the transition between the head section 16 and the neck section 17, a radius R1 is provided, and in the transition of the neck section 17 towards the outer surfaces of the plastic cover lens 11, a radius R2 is provided.

Figure 3:
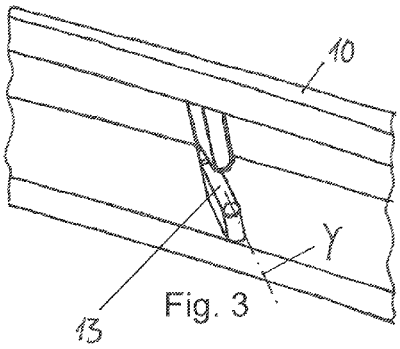
FIG. 3 is a detailed view of a locking means receiver on the mounting side of the backing strip.
Figure 4:
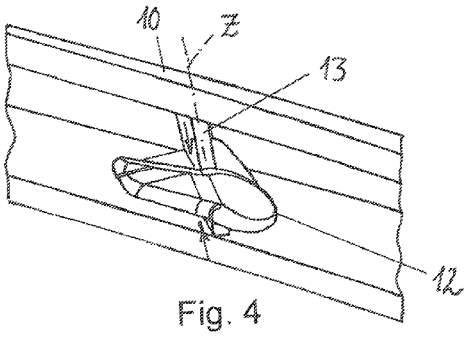
FIG. 4 is a detailed view of the locking means without showing the plastic cover lens in Assembly in the locking means receiver on the mounting side of the decorative trim and FIG. 5 is the assembly of a snapping means, which is latched in a complementary snapping means.

FIG. 3 shows the configuration of a locking means 13 on the mounting side of the decorative trim 10. The locking means receiver 13 forms a U-shaped recess, corre-sponding to the oblique extension of the locking means 16 in the transverse direction Y. If the decorative trim 10 is placed on the outer surface of the plastic cover lens 11, so that the U-shaped recess surrounds the transition region of the head section 16 in the neck section 17, as shown in FIG. 4. The limbs of the U-shaped recess thereby operate with the radius region R1, and through the locking means receiver 13 on the mounting side of the decorative trim 10, the head section 16 of the locking means 12 can consequently be engaged behind, whereby a form fit between the locking means 12 and locking mechanism receiver 13 results.

FIG. 4 shows the locking means 12 in the locking means receiver 13, whereby it is apparent that the U-shaped recess of the locking mechanism receiver 13 engages the head section 16 of the locking means 12 from behind. The neck section 17 thereby forms a support in the vertical direction Z for the decorative trim 10, wherein the support is indicated in the vertical direction Z by two arrows.

Figure 5:
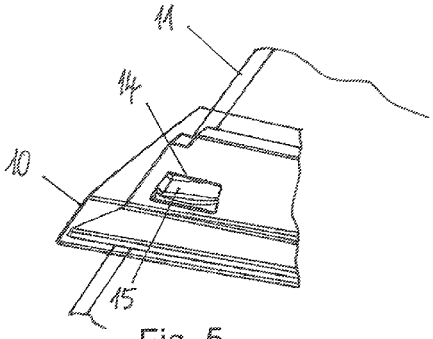

Finally, FIG. 5 shows the latching of the snapping means 14, designed as a latching from behind through a side wall of the decorative trim 10, with a complementary snapping means 15, which is designed as a molded recess on the exterior surface of the plastic cover lens 11. According to the principle of a catching hook, the decorative trim 10 can be secured opposite to the direction of extension of the locking means 12 in the transverse direction Y, so that ultimately the decorative trim 10 can be received in a form-fitting manner over the locking means 12 and the locking means receiver 13 on the plastic cover lens 11, and is secured over the latching of the snapping means 14 in the complementary snapping means 15. For graphical representation the decorative trim 10 is therefore transparently shown, and the snapping means 14 is constructed on the mounting side of the decorative trim 10 in the form of a latching from behind through a side wall.

The invention is not limited in its embodiment to the preferred embodiment described above. Rather, a number of variations are possible which make use of the illustrated solution even in fundamentally differently developed embodiments. All of the claims, the description or drawings resulting features and/or advantages, including design details, spatial configurations and procedural steps, can be essential to the invention on their own as well as in various combinations.

REFERENCE CHARACTER LIST

1 Assembly
10 Decorative trim
11 Plastic cover lens
12 Locking means
13 Locking means receiver
14 Snapping means
15 Complementary snapping means
16 Head section
17 Neck section
X Longitudinal direction
Y Transverse direction
Z Vertical direction
R1 Radius
R2 Radius

The invention claimed is:

1. An assembly comprising:

a plastic cover lens for a headlamp;

a decorative trim for selective attachment to said plastic cover lens;

locking means on an exterior surface of the plastic cover lens, said locking means extending outward in a trans-verse direction pointing at an angle from the exterior surface of the plastic cover lens;

locking means receivers formed on a mounting side of the decorative trim in which the locking means releasably engage; and at least one snapping means on the decorative trim extending outward in a transverse direction and a complementary snapping means on the plastic cover lens for releasable securing of the decorative trim towards the transverse direction.

2. The assembly according to claim 1, wherein the locking means comprises an extension designed in a cross-sectional geometric shape of a keyhole.

3. The assembly according to claim 2, wherein the cross-sectional geometric shape comprises a head section and a neck section in the manner of a keyhole.

4. The assembly according to claim 3, wherein the head section extends outward at an angle from the surface of a closure lid and whereby the neck section extends like ribs between the head section and the surface of the plastic cover lens.

5. The assembly according to claim 3 wherein the receiver of the locking means is constructed as a substantially U-shaped recess on the mounting side of the decorative trim, wherein the U-shaped recess is correspondingly constructed to the angled extension of the locking means.

6. The assembly according to claim 5, wherein the U-shaped recess surrounds the locking means in the transi-tion region between the head section and the neck section in a limb-like manner.

7. The assembly according to claim 3 wherein in the transition between the surface of the plastic cover lens and at least one of the constructed locking means and in the transition between the head section and the neck section corresponding radii are constructed.

8. The assembly according to claim 1 wherein at least a protective coating is painted onto at least one of the locking means and at least partially onto the surface of the plastic cover lens.

* * * * *